US007320744B2

(12) United States Patent
Pullinen et al.

(10) Patent No.: US 7,320,744 B2
(45) Date of Patent: Jan. 22, 2008

(54) MOISTENING ARRANGEMENT OF MULTIPLE-NIP CALENDER

(75) Inventors: Hannu Pullinen, Riihimäki (FI); Jorma Haag, Karkkila (FI)

(73) Assignee: Metso Paper, Inc., Helsinki (FI)

( * ) Notice: Subject to any disclaimer, the term of this patent is extended or adjusted under 35 U.S.C. 154(b) by 304 days.

(21) Appl. No.: 10/534,445

(22) PCT Filed: Nov. 11, 2003

(86) PCT No.: PCT/FI03/00852

§ 371 (c)(1),
(2), (4) Date: May 10, 2005

(87) PCT Pub. No.: WO2004/044315

PCT Pub. Date: May 27, 2004

(65) Prior Publication Data

US 2006/0075961 A1 Apr. 13, 2006

(30) Foreign Application Priority Data

Nov. 12, 2002 (FI) ..... 20022017

(51) Int. Cl.
*D21G 1/00* (2006.01)
*D21G 7/00* (2006.01)

(52) U.S. Cl. ..... 162/361; 162/205; 162/207; 100/75

(58) Field of Classification Search ..... 162/204–207, 162/358.1, 361, 358.3, 358.5; 100/161, 162 R, 100/163 R, 164, 165, 163 A, 166, 162 B, 100/158 R, 73–75, 38
See application file for complete search history.

(56) References Cited

U.S. PATENT DOCUMENTS 4,642,164 A 2/1987 Hanhikoski et al.
4,945,654 A 8/1990 Mason
6,264,795 B1 7/2001 Hamel (Continued)

FOREIGN PATENT DOCUMENTS

DE 298 15 847 U1 1/1999

(Continued)

OTHER PUBLICATIONS

Search Report issued in Finnish App. No. 20022017.

(Continued)

*Primary Examiner*—Eric Hug
(74) *Attorney, Agent, or Firm*—Stiennon & Stiennon

(57) ABSTRACT

A multiple-nip calender has a set of rolls (2) with roll nips (N) between the rolls. A moistening arrangement has a roll means (3) for moistening the fibre web comprising a damping unit (33) and rolls (32) guiding the fibre web (W). The roll means is located in a pocket (7) adjacent to the line (L) of the aligned set of rolls, the pocket being formed by a space defined by the fibre web (W), one idle roll (5) in the set of rolls and said roll means (3), the fibre web contacting said roll at two locations, in roll nips located on opposite sides of the roll mantle when viewed from the longitudinal axis of the roll, and circulating around the roll means (3). The fibre web (W) contacts said roll in the set of rolls preferably in the roll nip immediately preceding a reversing nip (N;N3).

8 Claims, 2 Drawing Sheets

U.S. PATENT DOCUMENTS 6,694,870 B1 2/2004 Pietikäinen et al.

FOREIGN PATENT DOCUMENTS

| | | | |
|---|---|---|---|
| FI | 71966 | | 11/1986 |
| FI | 72552 | | 2/1987 |
| FI | 107949 | B | 10/2001 |
| FI | 108655 | B | 2/2002 |
| GB | 2 150 163 | A | 6/1985 |
| WO | WO 00/79049 | * | 12/2000 |
| WO | WO 2004/044315 | A1 | 5/2004 |

OTHER PUBLICATIONS

International Preliminary Examination Report issued in PCT/FI03/00852, Aug. 16, 2004.

International Search Report issued in PCT/FI03/00852, Mar. 11, 2004.

* cited by examiner

MOISTENING ARRANGEMENT OF MULTIPLE-NIP CALENDER

CROSS REFERENCES TO RELATED APPLICATIONS

This application is a U.S. national stage application of International App. No. PCT/FI2003/000852, filed Nov. 11, 2003, the disclosure of which is incorporated by reference herein. This application claims priority on Finnish App. No. 20022017, filed Nov. 12, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a moistening arrangement of a multiple-nip calender.

Multiple-nip calenders comprise a plurality of nips formed between a polymer roll and a heated steel roll. While passing between the roll nips, the fibre web is calendered at its surface. Should it be desirable to calender both sides of the fibre web with a multiple-nip calender disposed in one frame, a "reversing nip" comprising two successive polymer rolls must be provided in the multiple-nip calender. The calendered fibre web should have as equal quality as possible both in the lateral and the longitudinal direction of the fibre web, and the fibre web consequently requires moistening both before entering the multiple-nip calender and while proceeding in the multiple-nip calender. Usually one to four fibre web damping units are disposed in a multiple-nip calender, the number of damping units depending principally on the number of nips in the calender and on the fact whether the calender has been disposed in one or two frames. With an increase of the number of roll nips in multiple-nip calenders, the fibre web will require increased damping. A reversing nip also requires increased damping of the fibre web, because both sides of the fibre web will require damping: usually damping is carried out in multiple-nip calenders equipped with a reversing nip just before the fibre web enters the multiple-nip calender, before the reversing nip. Damping that takes place before the reversing nip is usually performed by means of a damping unit disposed in "a pocket" between the output roll and the set of rolls. In multiple-nip calenders, the set of rolls is usually placed within a very narrow area, and for the fibre web to be efficiently moistened in the pocket, the number of damping units must be increased. The narrow pocket cannot accommodate very large and efficient damping units, because it already accommodates the crown variation means of the idle roll, and also auxiliary means such as steam boxes, in addition to the piping of the fibre web damping unit. Any attempts to solve the problem by enlarging the pocket with the output roll transferred further away from the line of the aligned set of rolls would risk generating vibrations caused by the increased torque of the output roll.

The purpose of the invention is to eliminate the prior art shortcomings described above. Consequently, the chief purpose of the invention is to provide a fibre web moistening arrangement in a multiple-nip calender equipped with a reversing nip, the moistening arrangement allowing for efficient location of the damping unit in the pocket of the multiple-nip calender.

The invention has the additional purpose of decreasing the number of fibre web damping units in multiple-nip calenders.

SUMMARY OF THE INVENTION

The damping arrangement of a multiple-nip calender of the invention, by means of which a fibre web to be calendered in a multiple-nip calender is moistened, comprises a set of rolls with roll nips between the rolls. The damping arrangement includes a roll means for damping the fibre web, which is located in a pocket adjacent to the line of the aligned set of rolls, the pocket consisting of a space defined by the fibre web, one of the idle rolls in the set of rolls and said roll means. The fibre web contacts this roll in the set of rolls at two locations, approximately at roll nips located on opposite sides of the roll mantle, viewed from the longitudinal axis of the roll, and the fibre web also circulates around the roll means. The roll means comprises a damping unit and also rolls guiding the fibre web relative to the damping unit. In a preferred embodiment, the fibre web touches this roll in the set of rolls in the roll nip located immediately before the reversing nip.

In this application, a reversing nip implies the roll nip formed between two polymer-coated rolls.

The invention is based on the fundamental idea of the output roll in a multiple-nip calender being replaced with a roll means, which comprises two guide rolls with relatively small diameter on each side of the frontal face of the damping unit (the surface through which water is sprayed). In this manner, an efficient and relatively large-sized damping unit can be accommodated in the otherwise narrow pocket of a multiple-nip calender. In a preferred embodiment of the invention, the guide rolls consist of a plurality of successive roll sections.

The moistening arrangement of the invention achieves several advantages over corresponding prior art arrangements for fibre web damping. Thus the nip vibrations of the set of rolls are reduced when an output roll with relatively large diameter is replaced with guide rolls having significantly smaller diameter and bulk, which are located in the damping roll means. There is no need to enlarge the pocket by transferring the output roll further out from the nip rolls, and thus increased nip vibrations are further avoided. A large-sized and efficient damping unit receivable in the pocket allows for a reduced number of damping units, resulting in a smaller number of piping and device units within the narrow roll area. The service distances to the set of rolls can also be maintained.

DESCRIPTION OF THE PREFERRED EMBODIMENTS

Figure 1:
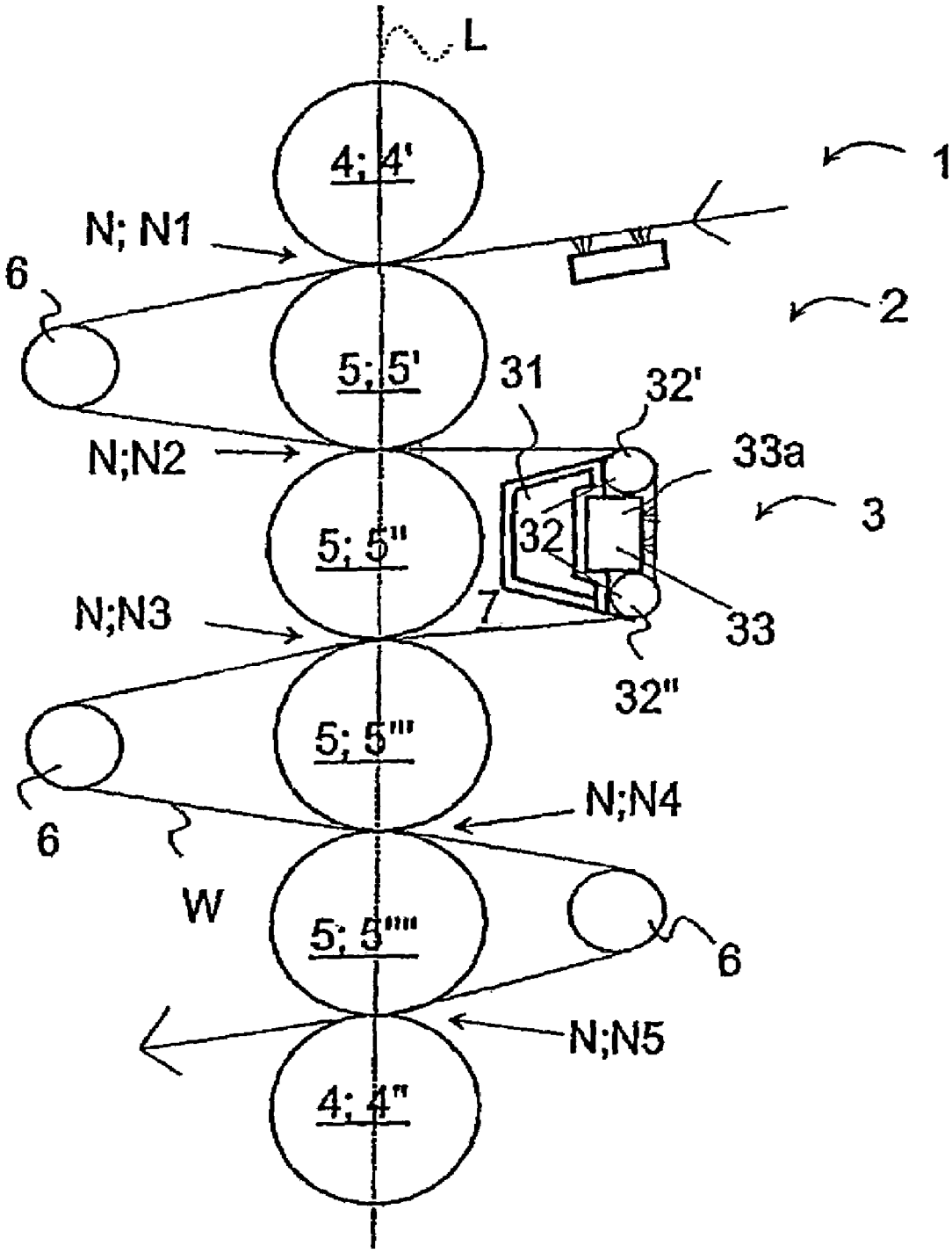
FIG. 1 is a schematic view of a multiple-nip calender of the invention.
Figure 2:
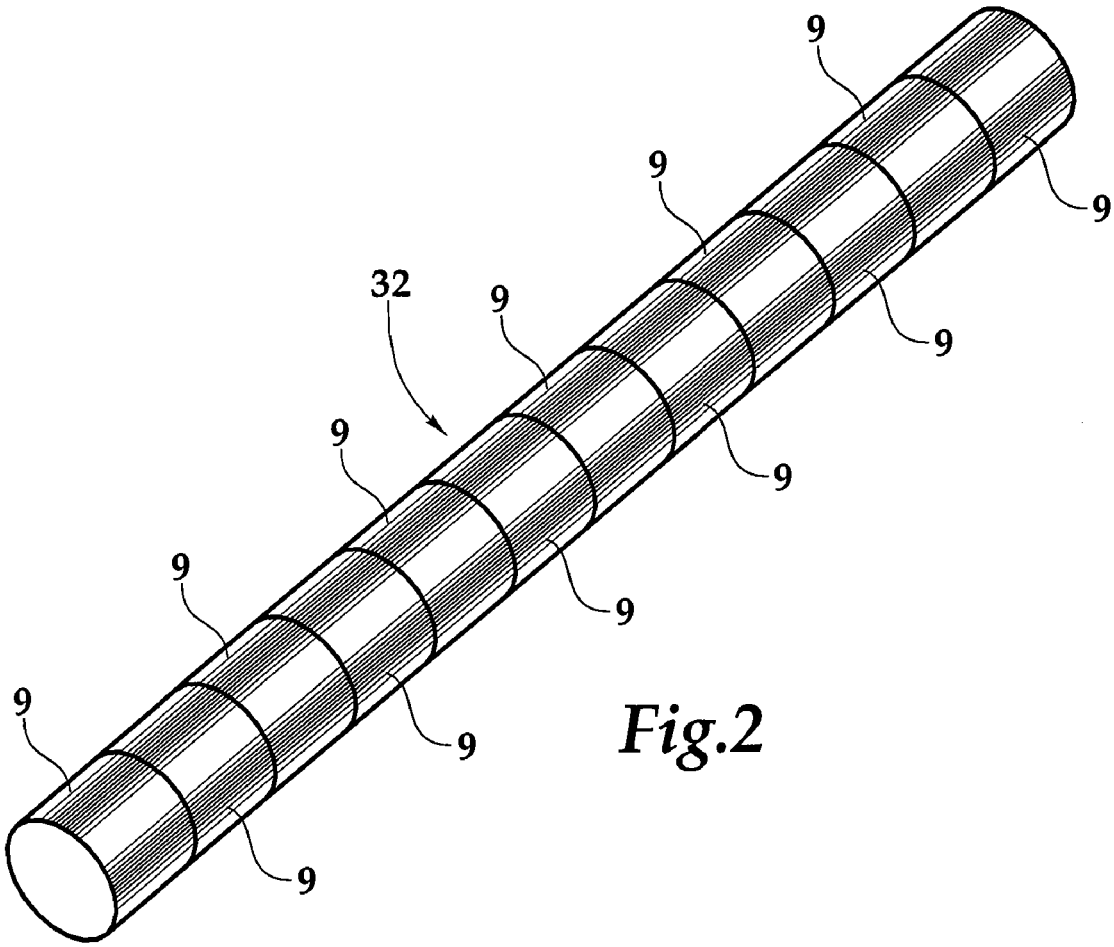
FIG. 2 is an isometric view of a guide roll of the multiple-nip calender of FIG. 1 comprising a plurality of short successive roll sections having identical diameters.

FIG. 1 shows schematically a set of rolls 2 in a multiple-nip calender 1, viewed directly from the end of the set of rolls. For the sake of clarity of the figure, the multiple-nip calender is shown in the figure devoid of the calender frame, the fibre web guide rolls, the load compensating means of the idle rolls, the upper and lower roll loading means and auxiliary means such as steam boxes. The multiple-nip calender illustrated in the figure is conventional with respect to these structures.

The set of rolls 2 of the multiple-nip calender 1 of FIG. 1 comprises six rolls. The outside of the set of rolls is located on the left of the central line L of the set of rolls, whereas the inside of the set of rolls is located on the right side. Consequently, the fibre web enters the set of rolls from the inside of the set of rolls and leaves the set of rolls to the outside. Both the uppermost and the lowermost roll 4;4' and 4;4" are equipped with hydraulic loading means within the roll for control of the nip pressure in the set of rolls and also for control of the nip pressure profile. Idle rolls 5, i.e. rolls 5;5', 5;5", 5;5'", and 5;5"" are alternatingly water-heated steel rolls with a hard surface and polymer-coated rolls. Polymer-coated rolls are thus rolls 4;4", 5;5', 5;5'", and 4;4", and steel rolls are rolls 5;5' and 5;5'". The ends of the idle rolls 5 comprise hydraulic roll crown variation means, which serve for completely or partly compensating roll crowning caused by the inherent roll mass and by the auxiliary means at the roll ends, in order to maintain the desired nip pressure profile of the multiple-nip calender. The crown variation means have a design that is conventional per se, such means being described e.g. in "*Wochenblatt für Papierfabrikation, Heft* 23/24 1997" and in other literature in the field. The set of rolls 2 exemplified in the figure comprises five roll nips N, of which the central nip N;N3 is a "reversing nip" for control of a single-sided fibre web. The idle rolls 5;5" and 5;5'" on different sides of the reversing nip are both polymer rolls. The line L of the set of rolls, i.e. the line L passing through the central point of the rolls in the set of rolls, is in a substantially vertical position. The roll nips N:N2, N;N4 and N;N5 are preceded by output/spreading rolls 6 in the calender, these rolls serving to spread the fibre web and to act on the period over which the heat of the thermo-roll acts on the fibre web before the fibre web reaches the following roll nip. In addition, these output/spreading rolls are used for removing folds on the fibre web. The spreading/output rolls 6 also equalize the distance between two successive roll nips over which the fibre web W travels in the machine cross-direction. The output roll located before the reversing nip N;N3 has been replaced with a roll means 3. In this roll means 3, the same frame 31 comprises attached fibre web damping unit 33 and guide rolls 32 steering the fibre web relative to the damping unit. The guide rolls 32 have a diameter notably smaller than that of the spreader rolls 6. Each guide roll 32 consists of "sectional rolls", which are formed by short successive guide rolls 9 mounted in the same frame and having identical diameters. The guide rolls 32 are disposed relative to the damping unit 33 so that the surface of the fibre web W passes in the vicinity of the frontal face 33*a* of the damping unit, the water jets being fed through this frontal face. The damping unit 33 may have a design that is conventional per Se, such as a design with two nozzle rows on the frontal face of the damping unit, each nozzle row comprising a plurality of small nozzles. Small water droplets are conducted though the nozzles so as to moisten the fibre web surface passing in the vicinity of the frontal face. For a more detailed description of the design of the damping units, we refer to prior art and to Metso Paper, Inc.'s damping unit of the range VIBAir Tech™, for instance.

A roll means 3 of the kind described above is located in the pocket 7 adjacent to the set of rolls 2. The pocket is formed in a space where the fibre web contacts the idle roll 5;5" (the mantle of the idle roll) in roll nips N;N2 and N;N3 and circulates around the roll means 3 via the guide rolls 32' and 32". The roll means 3 is at a suitable distance from the line L of the aligned set of rolls. The roll nips N;N2 and N;N3, in which the idle roll 5:5" is closest to the adjacent idle rolls 5;5' and 5;5'", are located roughly on opposite sides of the mantle of the idle roll 5;5", viewed from the longitudinal axis of the idle roll. The roll nip N; N3 is a "reversing nip", which is located between two polymer-coated idle rolls 5;5" and 5;5'". The roll nip N2, in turn, is located between the heated thermo-roll 5;5' (steel-coated idle roll) and the polymer-coated idle roll 5;5".

Placing a roll means 3 comprising a damping unit 33 of the kind described above in the pocket 7 to replace the spreader roll, which is usually located in this pocket, yields the appreciable advantage of allowing the damping unit and also its moistening performance to be adequately dimensioned.

The performance of the damping unit is usually directly proportional to the area through which water is sprayed (frontal face). Should the same pocket accommodate both an output roll and a damping unit, beside other auxiliary means in the pocket and also load compensating means, the damping unit would have to be dimensioned with smaller size and lower output, which would require an increased number of damping units. Optionally, the pocket 7 could be given a larger size by transferring the output roll 6 outwardly from the line L of the set of rolls, however, this would risk causing problems due to vibrations, which are generated by the increased torque of the guide roll and exerted on the frame of the multiple-nip calender.

One single moistening arrangement of the invention has been described above, yet it is obvious to those skilled in the art that the invention can be implemented in many other ways as well, without departing from the scope of the inventive idea defined in the claims. The arrangement of the invention can thus be used also in multiple-nip calendars with a divided frame. In such multiple-nip calenders, the fibre web requires damping, because the fibre web tends to dry over the web feeding from the first part to the second part of the set of rolls.

The invention claimed is:

1. A multiple-nip calender comprising:

a set of rolls having an upper roll, a lower roll, and a plurality of rolls between the upper roll and the lower roll, each of the plurality of rolls defining a first nip and a second nip on opposite sides of the roll, the first and second nips formed with adjacent rolls of said set of rolls;

a fiber web passing through the nips;

a pocket formed by the fiber web extending from the first nip of one of the plurality of rolls, to the second nip of said one of the plurality of rolls;

a roll means for damping a portion of the web extending from a first guide roll to a second guide roll of the roll means, the roll means disposed in the pocket and having a damping unit arranged to spray water on the portion of the web extending from the first guide roll to the second guide roll of the roll means, the first guide roll and the second guide roll arranged to guide the fiber web relative to the damping unit.

2. The multiple-nip calender of claim 1, wherein the set of rolls comprises a plurality of nips formed between polymer rolls and steel rolls, the calender having a reversing nip between two polymer rolls, and wherein said first nip of said one of the plurality of rolls is located immediately before the reversing nip and the second nip of said one of the plurality of rolls is the reversing nip.

3. The multiple-nip calender of claim 1, wherein the set of rolls define a plane passing through the nips formed between the upper roll, the lower roll and the plurality of rolls, and wherein the plane is vertical or at an angle to a horizontal plane.

4. The multiple-nip calender of claim 1, wherein the roll means has a frame, to which the damping unit and the first guide roll and the second guide roll are attached.

5. The multiple-nip calender of claim 1, wherein the damping unit has a frontal face from which water is arranged to be sprayed, the first guide roll and the second guide roll being located on ether side of the frontal face, the frontal face being in spaced parallel relation to the portion of the web extending from the first guide roll to the second guide roll.

6. The multiple-nip calender of claim 1, wherein the first guide roll and the second guide roll each comprise a plurality of short successive guide rolls having identical diameters which are mounted to the frame.

7. A moistening arrangement replacement for an output roll of a multiple-nip calender comprising:

a frame;

a first roll mounted to the frame;

a second roll mounted to the frame in spaced parallel relation to the first roll, and defining a damping space therebetween; and a damping unit mounted to the frame, the damping unit having a frontal face defining a surface though which water is sprayed, so that when a fiber web is passed from the multiple-nip calender to the first roll and from the first roll to the second roll and back to the multiple-nip calender, the fiber web passes over the frontal face and is moistened between the first roll and the second roll, the moistening arrangement serving to replace the output roll of a multiple nip calender.

8. The apparatus of claim 7, wherein the first guide roll and the second guide roll each comprise a plurality of short successive guide rolls having identical diameters which are mounted to the frame.

* * * * *